US005339752A

United States Patent [19]

Lewis

[11] Patent Number: 5,339,752

[45] Date of Patent: Aug. 23, 1994

[54] LIVESTOCK INCINERATOR

[76] Inventor: Larry D. Lewis, P.O. Box 112, Cedar, Iowa 52543

[21] Appl. No.: 93,016

[22] Filed: Jul. 19, 1993

[51] Int. Cl.[5] ..... F23G 1/00

[52] U.S. Cl. ..... 110/194; 110/193; 110/185; 110/187; 110/212

[58] Field of Search ..... 110/194, 193, 235, 212, 110/233, 185, 187

[56] References Cited

U.S. PATENT DOCUMENTS

| | | | |
|---|---|---|---|
| 1,263,257 | 4/1918 | Lewis . | |
| 1,492,371 | 6/1923 | Griffith et al. . | |
| 3,808,985 | 5/1974 | Raber | 110/3 |
| 4,321,878 | 3/1982 | Segrest | 110/194 |
| 4,603,644 | 8/1986 | Brookes | 110/194 |
| 5,014,630 | 5/1991 | Looker | 110/194 |

FOREIGN PATENT DOCUMENTS

| | | | |
|---|---|---|---|
| WO9220965 | 11/1992 | World Int. Prop. O. | 110/194 |

*Primary Examiner*—Edward G. Favors

*Attorney, Agent, or Firm*—Zarley, McKee, Thomte, Voorhees, & Sease

[57] ABSTRACT

A livestock incinerator is provided, and includes a compartment or incineration chamber defined by opposite sidewalls, opposite end walls, a bottom wall, and an open top which is selectively closed by a plurality of lids pivotally connected to the walls of the incinerator. The interior of the incinerator is lined with firebricks, including all the walls and the lids. The firebricks are secured in place by a plurality of T-shaped brackets which define channels for receiving the edges of the firebricks. A primary burner is operatively connected to the incinerator for heating the chamber such that the carcasses burn to ashes. An exhaust stack is connected to one of the lids, and includes an afterburner for further combusting the products of combustion from the chamber so as to prevent atmospheric pollution. The primary burner and afterburner are operatively connected in series so that if one burner fails to operate, the other burner will automatically cease operation.

12 Claims, 4 Drawing Sheets

LIVESTOCK INCINERATOR

BACKGROUND OF THE INVENTION

Incinerators for livestock carcasses are necessary to dispose of animals which have died. Conventional livestock incinerators typically have an access opening closed by a hinged door. Normally, the access opening is provided in a side wall or end wall of the incinerator, but does not provide unobstructive accessive to the internal combustion chamber. Therefore, placement of the carcass or carcasses into the chamber may be difficult, and cleaning of the chamber is inhibited. Also, conventional livestock incinerators utilize a single burner to generate heat within the chamber to burn the carcasses, with products of combustion being emitted to the atmosphere through an exhaust stack or smoke chimney. However, conventional livestock incinerators often times do not obtain complete combustion and therefore pollute the atmosphere with undesirable particles and gases.

Accordingly, a primary objective of the present invention is the provision of an improved livestock incinerator.

Another objective of the present invention is the provision of a livestock incinerator having at least two hinged doors movable between open and closed positions with respect to an enlarged access opening in the top of the incinerator.

A further objective of the present invention is the provision of a livestock incinerator having an exhaust stack which is hinged for movement between operative and inoperative positions with respect to the access opening.

Still another objective of the present invention is the provision of a livestock incinerator having an exhaust stack having an after burner operatively mounted therein for additional combustion of emissions.

A further objective of the present invention is the provision of a livestock incinerator wherein the housing includes firebricks therein and a plurality of T-shaped brackets for securing the firebricks within the housing.

Another objective of the present invention is the provision of a livestock incinerator having dual burners operatively coupled so that operational failure of one burner will cause the other burner to automatically cease operation.

Another objective of the present invention is the provision of a livestock incinerator which is economical to manufacture, and efficient, safe, and durable in operation.

These and other objectives of the present invention will become apparent from following description of the invention.

SUMMARY OF THE INVENTION

The livestock incinerator of the present invention includes a housing having opposite sidewalls and opposite end walls. The top of the housing is open so as to provide easy access to the interior combustion chamber within the housing. A pair of opposing lids are pivotally mounted on the opposite sidewalls of the housing, and a third lid is pivotally mounted to one end wall of the housing. The lids are movable between open and closed positions with respect to the top access opening of the housing. An exhaust stack is provided in the end lid.

The housing and the lids are lined with firebricks, which are secured in place by a plurality of T-shaped mounting brackets. The firebricks enhance the heat retention of the incinerator so that higher temperatures can be maintained with a minimum of fuel consumption. A burner is operatively connected to one wall of the housing to heat the internal combustion chamber for incinerating livestock carcasses. A second burner is provided in the exhaust stack so as to more completely combust the products of combustion from the first burner, thereby eliminating or minimizing atmosphere pollution from the incinerator.

DETAILED DESCRIPTION OF THE PREFERRED EMBODIMENT

Figure 1:
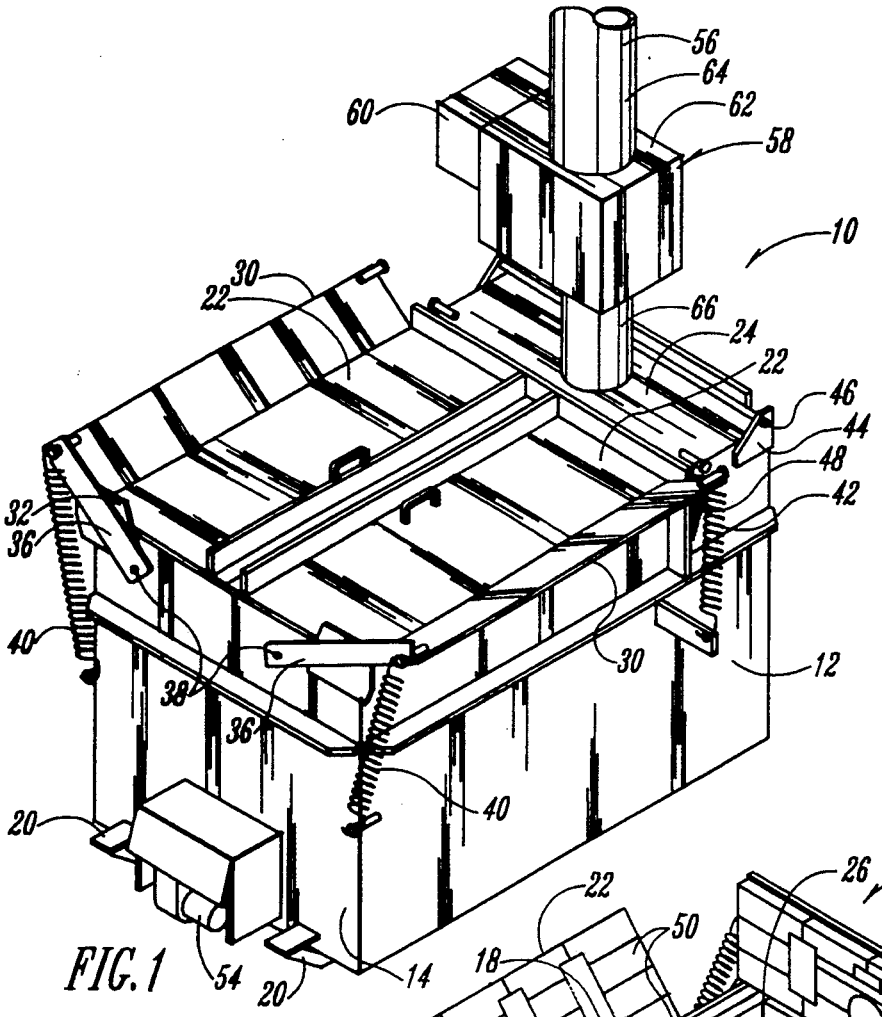
FIG. 1 is a perspective view of the livestock incinerator of the present invention wherein the lids are in a closed position.

The livestock incinerator of the present invention is generally designated by the reference numeral 10 in the drawings. Incinerator 10 includes opposite sidewalls 12 and opposite end walls 14. The incinerator also includes a bottom wall 16 and an open top defining an access opening 18. Legs 20 are provided on the incinerator 10 so that the bottom wall 16 is spaced a short distance above the ground, such that the incinerator can be moved with a forklift or the like.

Figure 2:
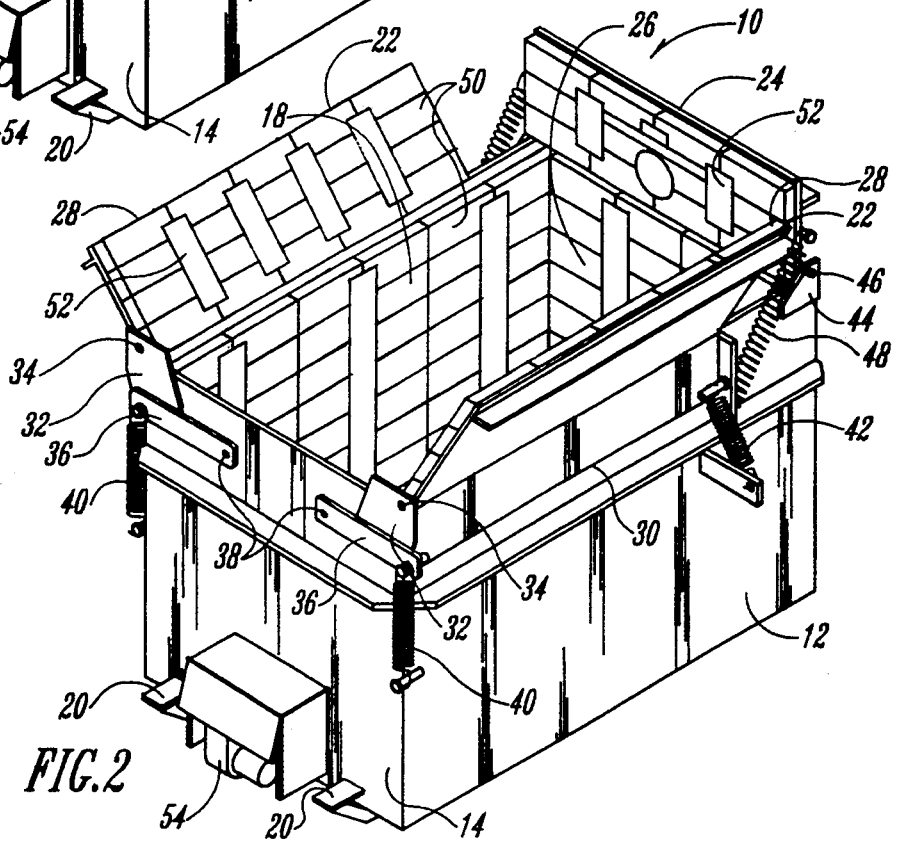
FIG. 2 is a perspective view of the livestock incinerator wherein the lids are in an open position.
Figure 3:
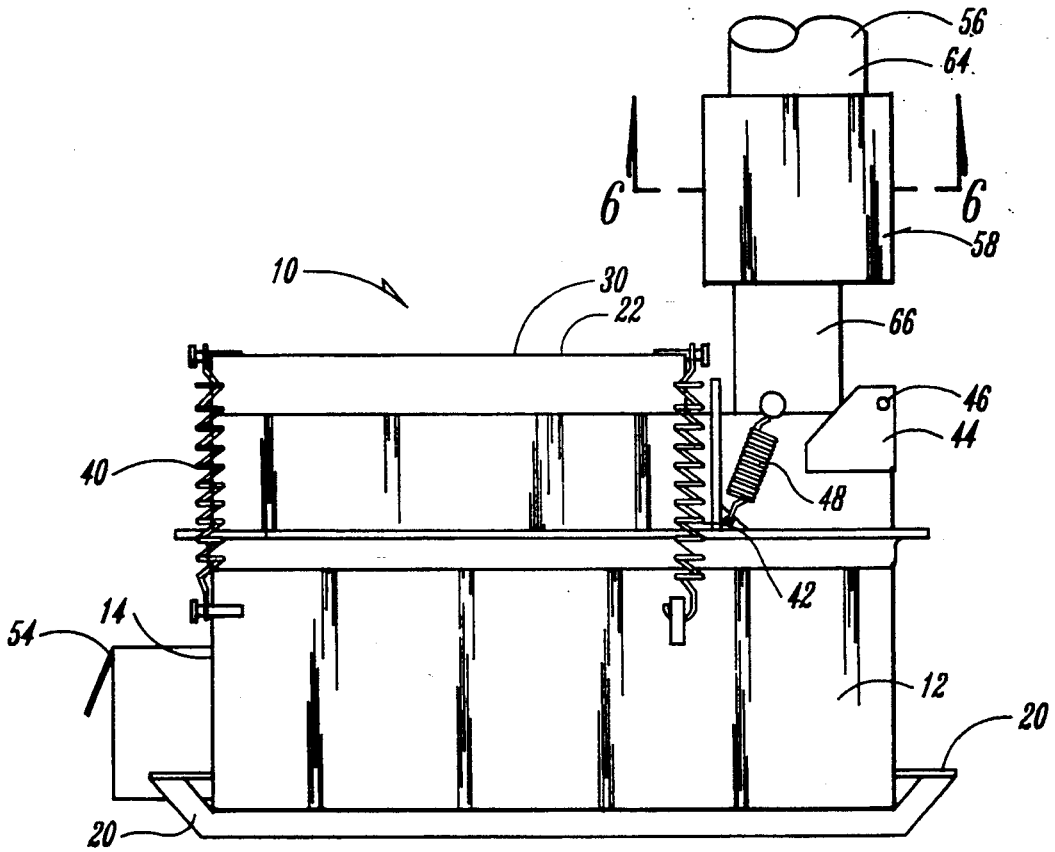
FIG. 3 is a side elevational view of the livestock incinerator shown in FIG. 1.
Figure 4:
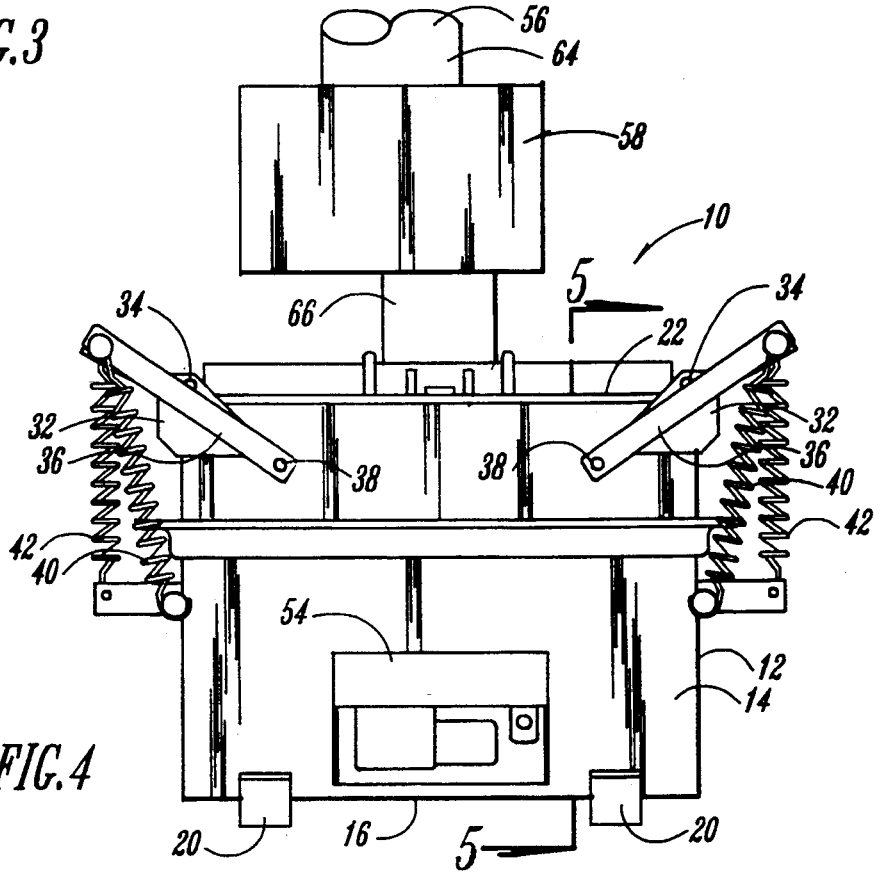
FIG. 4 is an end elevation view of the livestock incinerator.

A pair of opposing lids 22 are provided on the incinerator 10. Each lid 22 is pivotally mounted to the respective sidewalls 12 so as to be movable between closed and open positions, as seen in FIGS. 1 and 2 respectively. A third lid 24 is pivotally mounted to one end wall 14, so as to be movable between closed and open positions, also as seen in FIGS. 1 and 2, respectively. As seen in FIG. 2, when the primary lids 22 and the third lid 24 are moved to the open position, the entire top of the incinerator is open for access for loading carcasses into the incinerating or combustion chamber 26 defined by the walls of the incinerator, or for cleaning of the chamber.

Each of the opposing lids 22 have opposite inner and outer edges 28, 30 respectively. A mounting bracket 32 is provided at the front end of each lid 22 intermediate opposite edges 28-30. A similar mounting bracket is provided on each side wall 12 at the rearward end of lids 22. Thus, the lids 22 are pivotal about a pivot axis 34 for movement between the open and closed positions. A lever arm 36 has a first end pivotally connected to the front end wall 14 so as to pivot about a pivot axis 38. The opposite end of each lever arm 36 is attached to the respective lids 22 adjacent to outer edge 30 thereof. A spring 40 is attached to the outer end of each lever arm 36 and to a wall of the incinerator 10. A similar spring 42 is provided at the opposite end of each lid 22 and is operatively secured to the outer edge 30 of the respective lid and the sidewall 12 of the incinerator 10. Springs 40 and 42 normally biased the lids to the open position, once the lids are moved over center with respect to the pivot axis 34.

The rear or third lid 24 is pivotally mounted between a pair of mounting brackets 44 for pivotal movement about a pivot axis 46 between the open and closed positions. A spring 48 is provided on each side of the third lid 24 and is connected between the lid 24 and sidewall 12 of the incinerator 10. The springs 48 normally bias the lid 24 to the closed position.

As seen in FIG. 2, when all three lids are open, the entire access opening 18 is exposed. The lids are tilted away from the opening 18, thereby forming a chute-like entrance to the chamber 26, with an area greater than 100% of the access opening 18.

Figure 5:
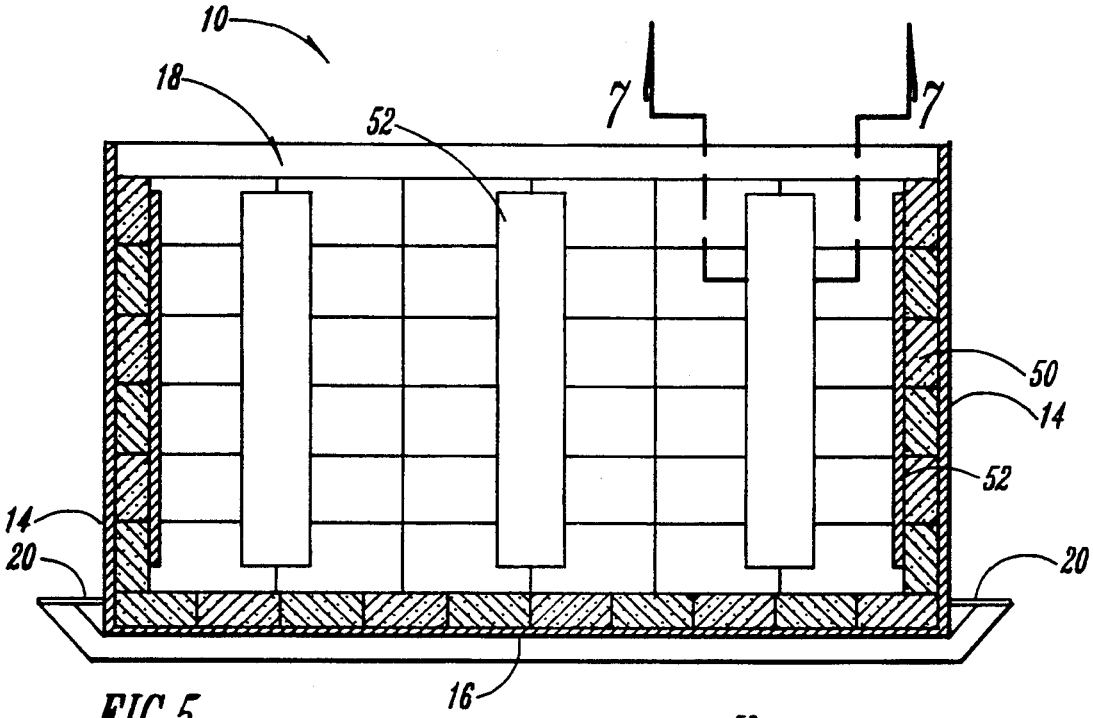
FIG. 5 is a sectional view taken along lines 5—5 of FIG. 4.
Figure 7:
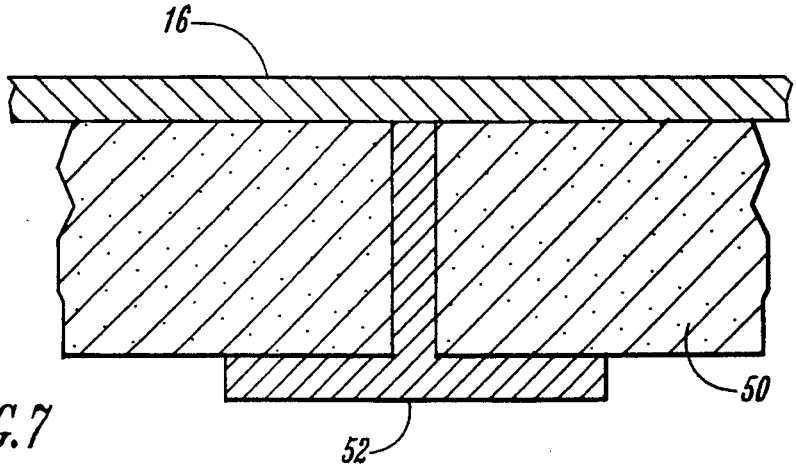
FIG. 7 is an enlarged sectional view taken along lines 7—7 of FIG. 5.

As best seen in FIGS. 2 and 5, the interior of the incinerator is lined with firebricks 50. More particularly, each sidewall 12, each end wall 14, the bottom wall 16, and each lid 22, 24 includes firebricks which are secured in place by a T-shaped brackets 52. The plurality of brackets 52 are utilized to secure adjacent rows of the firebrick 50 in place on the respective walls or lids. As seen in FIG. 7, the T-shaped bracket secured to the wall or lid by welding and defines a channel for receiving the edges of the firebricks 50. The length of the T-shaped bracket 52 varies depending upon which wall or lid the bracket is utilized on.

A primary burner 54 is operatively mounted on the front wall 14 of the incinerator 10. Preferably, the burner 54 burns No. 2 diesel fuel, though other fuel may be utilized. When operating, the burner 54 provides heat to the incineration chamber 26.

Figure 6:
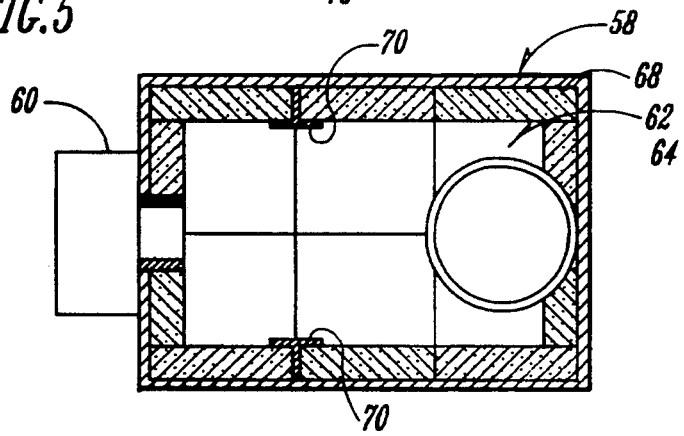
FIG. 6 is a sectional view taken along lines 6—6 of FIG. 3.

An exhaust stack or smoke chimney 56 extends through and from the third lid 24 so that products of combustion from the chamber 26 can be expelled to the atmosphere. The stack 56 includes an after burner system 58 for providing further combustion and incineration of particles and gases passing through this stack, so that the emissions from the stack are essentially clean and non-polluting. More particularly, the after burner 58 includes an auxiliary burner 60 operatively connected to a combustion chamber 62 mounted between upper and lower stack sections 64–66. The combustion chamber 62, as seen in FIG. 6, is lined with firebricks 68 which are held in place by a plurality of T-shaped brackets 70, similar to brackets 52 previously described.

Figure 8:
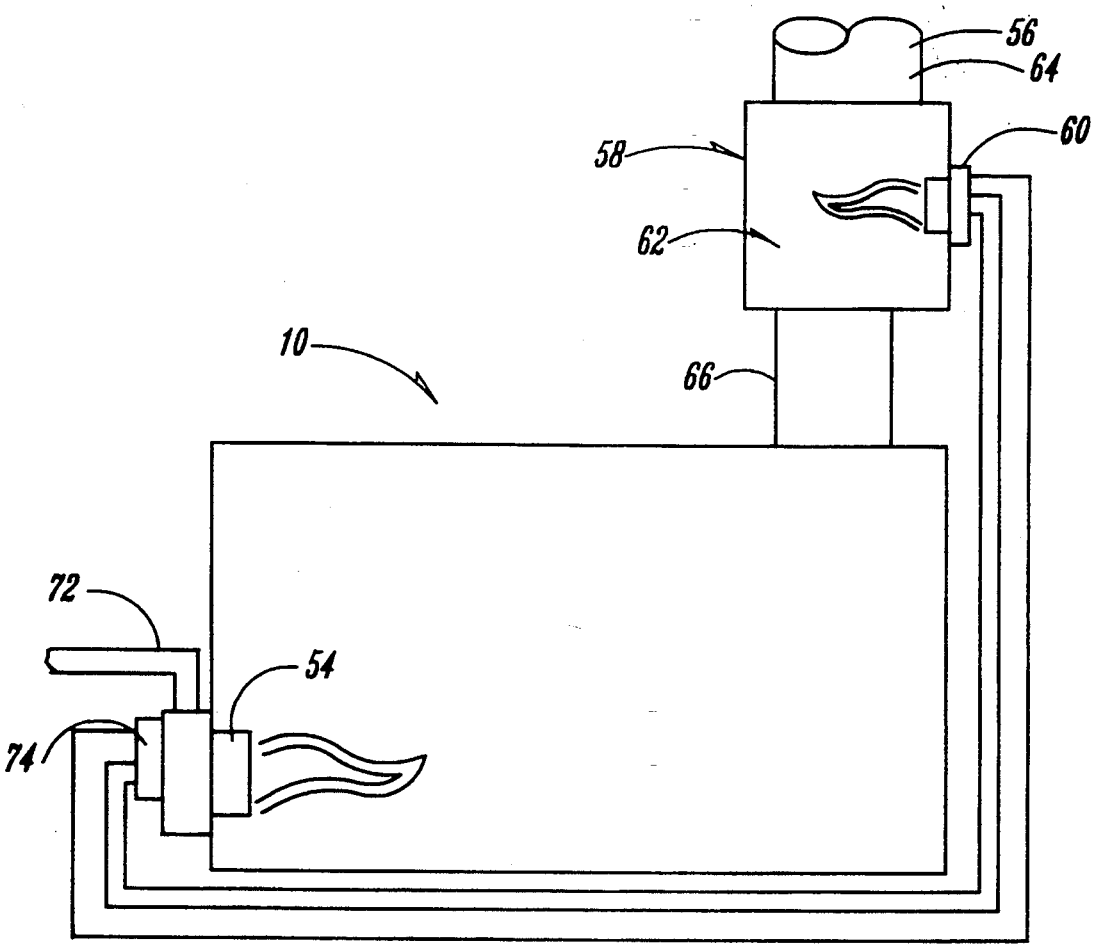
FIG. 8 is a schematic view showing the livestock incinerator of the present invention, including the dual burners of the incinerator.

As seen in FIG. 8, an incoming fuel line 72 provides fuel to each of the burners 54 and 60. The burners are wired in series and a safety device 74 is provided so that if one burner fails or malfunctions, the other burner will automatically cease operation. The safety device includes a CAD cell eye, such as that which is commercially available from Honeywell. The burners 54 and 60 are commercially available from Wayne Home Equipment of Ft. Wayne, Ind. Other burner brands may also be utilized.

In operation, one or more of the lids 22 and 24 can be opened to allow one or more carcasses to be placed into the incineration chamber 26. The lids are then closed and the primary burner 54 actuated so as to raise the temperature within the chamber 26 to a level sufficient to burn the carcass to ashes. The secondary burner 60 is also actuated so as to fully combust emissions passing from the combustion chamber 26 into the stack or chimney 56 before the products combustion are expelled to the atmosphere. With the incinerator of the present invention, obnoxious odors and smoke are substantially reduced or eliminated. After incineration is complete, the lids 22 and 24 can be opened so as to provide full access to the combustion chamber for removal of ashes and for other cleaning or repair needs.

The incinerator of the present invention is not limited to use for burning livestock carcasses, but can also be used in other environments. It is also understood that the above-described embodiment can be varied without departing from the scope of the present invention.

From the foregoing, it can be seen that the present invention accomplishes at least all of the stated objectives.

What is claimed is:

1. A livestock incinerator, comprising,
a compartment having opposite ends and opposite sides, and an open top;
a first lid pivotally secured to the open top adjacent one of the ends;
a smoke stack secured to and extending upwardly from the first lid;
a pair of second lids pivotally secured to the open to at the opposite sides and abutting each other and the first lid to close the open top; and
a burner in the compartment.

2. The device of claim 1 wherein the compartment has interior side walls, spaced T-shaped vertical brackets having flanges spaced from the side walls, and firebricks adjacent the side walls and held in place by the brackets.

3. The device of claim 1 wherein an after burner is located in the smoke stack.

4. The device of claim 3 wherein the after burner and the burner are operatively connected in series so that if one fails to operate, the other will cease operation.

5. An incinerator for livestock carcasses, comprising:
a housing having opposite ends and opposite sides defining an incinerating chamber, and an access opening to the chamber;
a pair of lids pivotally attached to the housing for movement between a first closed position covering the access opening and a second open position;
first burner means for providing sufficient heat to the chamber for incinerating a carcass; and
exhaust means mounted on the housing for expelling products of combustion from an incinerated carcass, said exhaust means being pivotally mounted to the housing for movement between an operative position and an inoperative position.

6. An incinerator for livestock carcasses, comprising:
a housing having opposite ends and opposite sides defining an incinerating chamber, and an access opening to the chamber;
said housing including a plurality of firebricks therein and a plurality of T-shaped brackets for securing the firebricks in position within the housing;
a pair of lids pivotally attached to the housing for movement between a first closed position covering the access opening and a second open position;
first burner means for providing sufficient heat to the chamber for incinerating a carcass; and
exhaust means mounted on the housing for expelling products of combustion from an incinerated carcass.

7. An incinerator for livestock carcasses, comprising:

a housing having opposite ends and opposite sides defining an incinerating chamber, and an access opening to the chamber;

a pair of lids pivotally attached to the housing for movement between a first closed position covering the access opening and a second open position, each lid including firebricks secured thereto;

first burner means for providing sufficient heat to the chamber for incinerating a carcass; and exhaust means mounted on the housing for expelling products of combustion from an incinerated carcass;

8. An incinerator for livestock carcasses, comprising:

a housing having opposite ends and opposite sides defining an incinerating chamber, and an access opening to the chamber;

a pair of lids pivotally attached to the housing for movement between a first closed position covering the access opening and a second open position;

first burner means for providing sufficient heat to the chamber for incinerating a carcass;

exhaust means mounted on the housing for expelling products of combustion from an incinerated carcass, said exhaust means being mounted on a third lid pivotally secured to the housing adjacent one end thereof for movement between open and closed positions.

9. An incinerator for livestock carcasses, comprising:

a housing having opposite ends and opposite sides defining an incinerating chamber, and an access opening to the chamber;

a pair of lids pivotally attached to the housing for movement between a first closed position covering the access opening and a second open position;

first burner means or providing sufficient heat to the chamber for incinerating a carcass;

exhaust means mounted on the housing for expelling products of combustion from an incinerated carcass;

second burner means in the exhaust means to further burn products of combustion;

first and second burner means are operatively coupled so that each of the burner means will cease operation when the other burner means ceases operation.

10. An incinerator for livestock carcasses, comprising:

a housing having opposite ends and opposite sides defining an incinerating chamber, and a top access opening to the chamber;

a pair of lids pivotally attached to the housing or movement between a first closed position covering the access opening and a second open position;

said lids define a chute into the top of the chamber when moved to the open position, and said lids in the open position define an area greater than the area of the access opening covered by the lids;

first burner means for providing sufficient heat to the chamber for incinerating a carcass;

second burner means located in the exhaust means and above the first burner means to further burn products of combustion from a carcass left stationary in said chamber; and exhaust means mounted on the housing for expelling products of combustion from an incinerated carcass, said exhaust means being pivotally mounted to the housing for movement between an operative position and an inoperative position.

11. The incinerator of claim 9 wherein the second burner means includes a combustion chamber lined with firebricks.

12. The incinerator of claim 11 further comprising T-shaped brackets secured to each lid for retaining the firebricks in position on the respective lid as each lid moves between the open and closed positions.

* * * * *